United States Patent [19]

Swisher, Jr.

[11] 4,174,949

[45] Nov. 20, 1979

[54] BURNER AND EXHAUST CONTROL ASSEMBLIES FOR USE WITH AN APPARATUS FOR CONVEYING PARTICULATE MATERIAL

[75] Inventor: George W. Swisher, Jr., Oklahoma City, Okla.

[73] Assignee: CMI Corporation, Oklahoma City, Okla.

[21] Appl. No.: 828,750

[22] Filed: Aug. 29, 1977

[51] Int. Cl.[2] ..... F27B 15/00

[52] U.S. Cl. ..... 432/58

[58] Field of Search ..... 432/58

[56] References Cited

U.S. PATENT DOCUMENTS

| | | | |
|---|---|---|---|
| 2,189,194 | 2/1940 | Brush | 432/58 |
| 2,634,117 | 4/1953 | Bloxham | 432/58 |
| 3,265,775 | 8/1966 | Friedrich | 432/58 X |
| 3,365,049 | 1/1968 | Raab | 198/688 |
| 3,561,907 | 2/1971 | Campbell | 198/688 |
| 3,982,884 | 9/1976 | Godel | 432/58 |
| 4,020,564 | 5/1977 | Bayliss | 432/58 |
| 4,025,296 | 5/1977 | Buchner | 432/58 |

*Primary Examiner*—John J. Camby

*Attorney, Agent, or Firm*—Dunlap, Codding & McCarthy

[57] ABSTRACT

In a conveyor apparatus for conveying particulate material from an input end for discharge from an output end disposed vertically higher than the input end, the improvement comprising a burner assembly, including a flame burner connected to the conveyor apparatus, for directly heating the particulate material in the conveyor apparatus via the flame burner in one position thereof, and for indirectly heating the particulate material via the products of combustion only of the flame burner in one other position thereof. A further improvement consists of an improved exhaust control system wherein the velocity of the gases exiting from the conveyor apparatus is rapidly decreased to induce precipitation of substantially all particulate material entrained therein prior to exhaustion to the atmosphere.

8 Claims, 5 Drawing Figures

BURNER AND EXHAUST CONTROL ASSEMBLIES FOR USE WITH AN APPARATUS FOR CONVEYING PARTICULATE MATERIAL

CROSS-REFERENCE TO RELATED PATENT APPLICATIONS

The subject matter of the present patent application is related to the subject matter disclosed in U.S. patent application No. 787,306 filed by George W. Swisher, Jr., Apr. 14, 1977, now U.S. Pat. No. 4,136,964 for "APPARATUS FOR SIMULTANEOUSLY MIXING AND CONVEYING PARTICULATE MATERIAL."

BACKGROUND OF THE INVENTION

1. Field of the Invention

This invention relates generally to improvements in conveying apparatus and, more particularly, but not by way of limitation, to improved burner and exhaust control assemblies on apparatus for conveying particulate material.

2. Description of the Prior Art

Numerous types of apparatus have been proposed in the past for conveying particulate material in a heated environment. As a general rule, such apparatus are designed to heat the particulate material either by direct exposure thereof to a heating flame, as from a flame burner, or by exposure to the products of combustion resulting therefrom only. As a consequence, the versatility of such single-function apparatus is generally limited thereby decreasing the utility and value thereof.

In conjunction with such prior art apparatus, it is not unusual to encounter complex and expensive exhaust control systems designed to limit the expulsion of particulate pollutants into the environment. However, such systems seldom represent an economical exchange in terms of expenses of installation, maintenance and operation, for the improvements in environmental quality resulting therefrom.

SUMMARY OF THE INVENTION

In a conveyor apparatus for conveying particulate material from an input end for discharge from an output end disposed vertically higher than the input end, the improvement comprising a burner assembly, including a flame burner connected to the conveyor apparatus for directly heating the particulate material in the conveyor apparatus via the flame burner in one position thereof, and for indirectly heating the particulate material in the conveyor apparatus via the products of combustion only of the flame burner in one other position thereof. A further improvement consists of an improved exhaust control system wherein the velocity of the gases exiting from the conveyor apparatus is rapidly decreased to induce precipitation of substantially all particulate material entrained therein.

It is the primary object of the present invention to provide an improved burner assembly for selectively heating particulate material being conveyed via a conveyor apparatus via the flame of a flame burner in one mode of operation and via the products of combustion only of said burner in one other mode of operation.

Another object of the present invention is to provide a simple yet effective apparatus for heating particulate material being conveyed by a conveyor apparatus.

A further object of the present invention is to provide an efficient and economical apparatus for controlling the rate of heating of particulate material being conveyed via a conveyor apparatus.

Yet another object of the present invention is to provide an improved exhaust control system for minimizing the quantity of solid particle pollutants expelled into the surrounding atmosphere via a particulate material conveying apparatus.

Other objects and advantages of the present invention will be evident from the following detailed description when read in conjunction with the accompanying drawings which illustrate embodiments of the present invention.

DESCRIPTION OF THE IMPROVED BURNER ASSEMBLY

Figure 1:
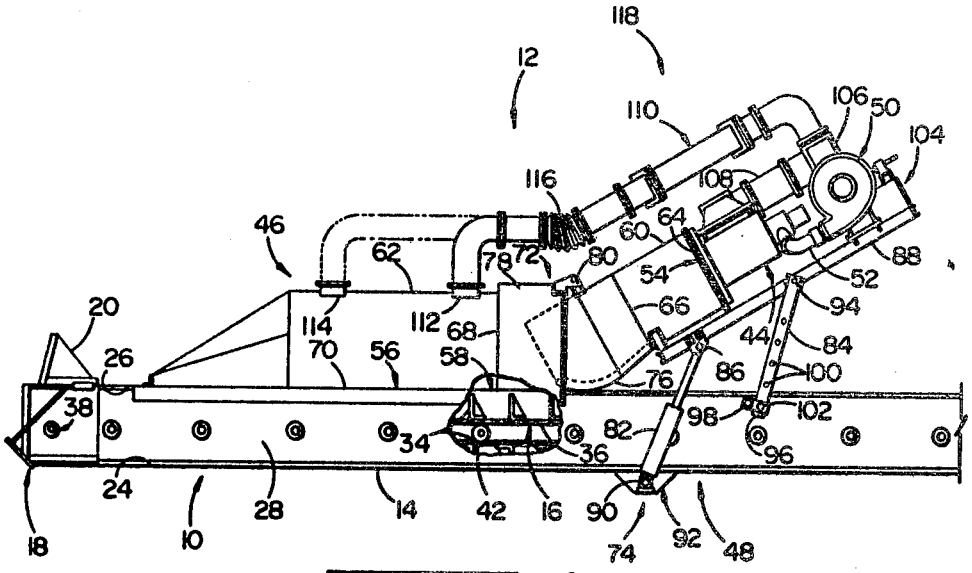
FIG. 1 is a partial side elevational view of a conveyor apparatus having an improved burner assembly constructed in accordance with the preferred embodiment of the present invention, the burner assembly being shown in a first position thereof.
Figure 2:
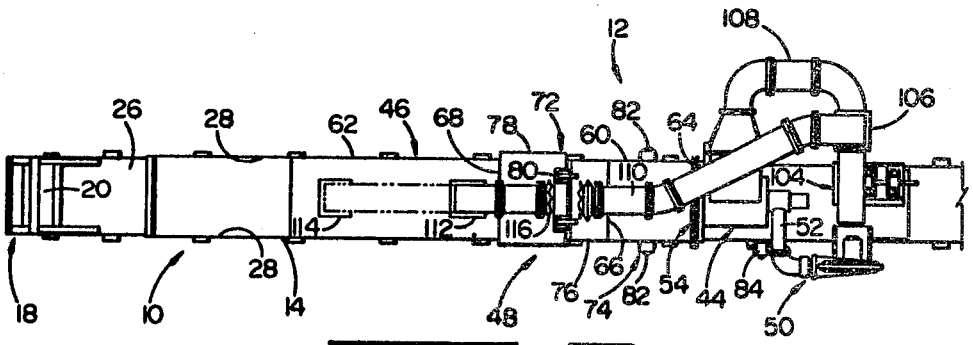
FIG. 2 is a partial top plan view of the conveyor apparatus and burner assembly shown in FIG. 1.
Figure 3:
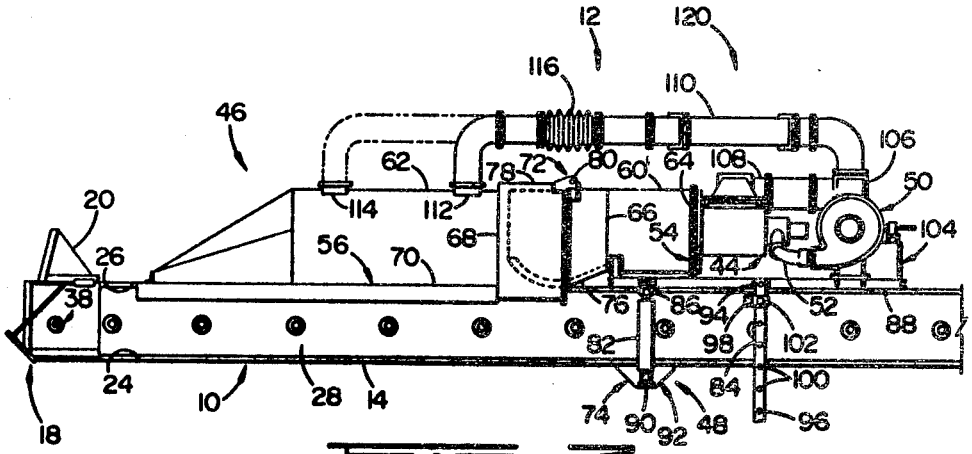
FIG. 3 is a partial side elevational view of the conveyor apparatus and burner assembly shown in FIG. 1 with the burner assembly in a second position thereof.

Referring to the drawings in general, and to FIGS. 1, 2 and 3 in particular, shown therein and referred to by the general reference numeral 10 is a conveyor apparatus having an improved burner assembly 12 constructed in accordance with the preferred embodiment of the present invention. For the purposes of explanation, the conveyor apparatus 10 is constructed substantially the same as the mixing and conveying apparatus shown and described in the Applicant's copending U.S. patent application Ser. No. 787,306, entitled "Apparatus for Simultaneously Mixing and Conveying Particulate Material," filed, Apr. 14, 1977, and assigned to the Assignee of the present invention. In particular, the conveyor apparatus 10 is comprised primarily of a housing 14 and a conveyor 16. The housing 14 has an input end 18 provided with an input hopper 20, and an output end 22 (see FIG. 4), the output end 22 being disposed vertically higher than the input end 18 thereof in the operating position of the conveyor apparatus 10. The housing 14 has a generally rectangular cross-sectional shape formed from a lower wall section 24, an upper wall section 26, and a pair of opposite side wall sections 28. Preferrably, each of the wall sections 24, 26 and 28 includes a layer of high temperature insulating material to facilitate retention of the heat generated during the operation of the burner assembly 12.

The conveyor 16 is disposed within the housing 14, from the input end 18 to the output end 22 thereof, and is constructed to lift particulate material fed into the housing 14 via the input hopper 20 upwardly from the input end 18 for discharge from the output end 22 via an outlet port 30 and a downwardly directed output chute 32. More particularly, the conveyor 16 is comprised primarily of a plurality of lifting surfaces 34 connected at spaced intervals to a continuous drag chain 36 disposed around and extending between a tail pulley 38 connected to the housing 14 adjacent the input end 18 thereof and a head pulley 40 (see FIG. 4) connected to the housing 14 adjacent to the output end 22, with a plurality of idler pulleys 42 being positioned along and providing support for the length of the drag chain 36.

The burner assembly 12 is comprised primarily of a flame burner 44, a combustion chamber assembly 46, and a burner positioning assembly 48. Hydrocarbon fuel for the flame burner 44 may be supplied in a conventional manner from a suitable source of fuel (not shown), while combustion-supporting air is preferrably supplied by a primary blower assembly 50 via a primary combustion air duct 52. The combustion chamber assembly 46 has an inlet portion 54 connected to the flame burner 44 and admitting the flame produced thereby to the interior thereof, and an outlet portion 56 connected around a heating port 58 provided through the upper wall section 26 of the housing 14 to facilitate introduction of the heated exhaust gases and other products of combustion produced by the flame burner 44 into the housing 14. Preferably the combustion chamber assembly 46 has the inner surfaces thereof lined with a suitable refractory material.

In a preferred form, the combustion chamber assembly 46 is comprised of a primary combustion chamber 60 and a secondary combustion chamber 62. The primary combustion chamber 60 has an inlet portion 64 connected to the flame burner 44, and an outlet portion 66, with the flame and products of combustion produced by the flame burner 44 entering the primary combustion chamber 60 via the inlet portion 64 and exiting from the outlet portion 66 thereof. The secondary combustion chamber 62 has an inlet portion 68 disposed adjacent to the outlet portion 66 of the primary combustion chamber 60, and an outlet portion 70 connected to the housing 14 around the heating port 58, the secondary combustion chamber 62 admitting the flame and products of combustion produced by the flame burner 44 via the inlet portion 68, and introducing the flame or products of combustion or both into the housing 14 via the outlet portion 70, depending upon the positioning of the primary combustion chamber 60 via the burner positioning assembly 48.

The burner positioning assembly 48 is comprised primarily of an interface assembly 72 and a position control assembly 74. The interface assembly 72 includes a generally scoop-shaped flame guide 76 which is connected to the primary combustion chamber 60 around the outlet portion 66 thereof, and a shroud 78 connected to the secondary combustion chamber 62 around the inlet portion 68 thereof, the shroud 78 being pivotally connected to the flame guide 76 via a pair of hinges 80 and substantially enclosing the flame guide 76 so as to maintain communication between the primary and secondary combustion chambers 60 and 62, respectively, during rotation of the flame guide 76 relative to the shroud 78.

The position control assembly 74 includes a pair of hydraulic rams 82 and a pair of guide rods 84. Each of the rams 82 is pivotally connected at one end 86 thereof to a support frame 88 upon which the primary combustion chamber 60 and various burner apparatus is connected, while the other end 90 of each ram 82 is pivotally connected to the housing 14 as at 92. In a somewhat similar manner, each of the guide rods 84 has one end 94 thereof pivotally connected to the support frame 88, while the other end 96 thereof is slidably disposed through a sleeve guide member 98 which is pivotally connected to the housing 14. Each of the guide rods 84 is provided with a plurality of perforations 100 therethrough at spaced intervals along the length thereof, while each of the sleeve guide members 98 is provided with a locking pin 102 which may be disposed through a selected one of the perforations 100 so that, following positioning of the burner assembly 12 in a desired position via the rams 82, the guide rods 84 may be locked in position whereby relieving much of the stress of which the rams 82 would normally be subjected during operation of the burner assembly 12.

In the preferred embodiment, a secondary blower assembly 104 is connected to the support frame 88 adjacent to the primary blower assembly 50, with the output thereof being routed through a control damper 106 into the primary combustion chamber 60 via a secondary combustion air duct 108. In addition, a portion of the output of the secondary blower assembly 104 may be diverted via the control damper 106 and a temperature dilution air duct 110 for injection into the secondary combustion chamber 62 via a first air inlet 112 as shown in full lines in FIGS. 1 through 3, or via a second air inlet 114 as shown in phantom in FIGS. 1 through 3. For ease of operation and adjustment, the dilution air duct 110 is provided with a flexible portion 116 adjacent to the interface assembly 72 so as to assure continuity of the temperature dilution air duct 110 in substantially all positions of the burner assembly 12.

Upon actuation of the burner assembly 12, the temperature of the exhaust gases and products of combustion issuing from the primary combustion chamber 60 into the secondary combustion chamber 62 may be varied in a conventional manner using the conventional controls of the flame burner 44, as well as the volume of the secondary combustion air injected into the primary combustion chamber 60 from the secondary blower assembly 104 via the secondary combustion air duct 108. The temperature of the exhaust gases and products of combustion in the secondary combustion chamber 62 may be further controlled by varying the volume of the temperature dilution air injected into the secondary combustion chamber 62 from the secondary blower assembly 104 via the temperature dilution air duct 110. An additional level of temperature control is provided by the ability to shift the point of injection of the temperature dilution air between the first and the second inlets 112 and 114, respectively, into the secondary combustion chamber 62.

Once the output temperature of the exhaust gases and products of combustion issuing from the primary combustion chamber 60 into the secondary combustion chamber 62 has been established, the degree of exposure of the particulate material being conveyed through the housing 14 past the heating port 58 via the conveyor 16 may be selected by actuating the rams 82 to pivot the flame burner 44 and the other elements mounted on the frame 88 about the hinge 80, between a first operating position 118 shown in FIG. 1 and a second position 120 shown in FIG. 3. When the burner assembly 12 is in the desired position, the guide rods 84 may be locked in position via the lock pins 102. Thus, when it is desired to directly heat the particulate material being conveyed by the conveyor apparatus 10 using the flame as well as the products of combustion produced by the flame burner 44, the burner assembly 12 may be positioned in the first operating position 118. On the other hand, when it is desired to indirectly heat the particulate material being conveyed by the conveyor apparatus 10 using only the products of combustion, the burner apparatus 12 may be positioned in the second operating position 120. Of course, the burner assembly 12 may be positioned intermediate the first and second operating positions 118 and 120, respectively, to achieve a desired degree of exposure of the particulate material to the flame.

DESCRIPTION OF THE EXHAUST CONTROL SYSTEM

Figure 5:
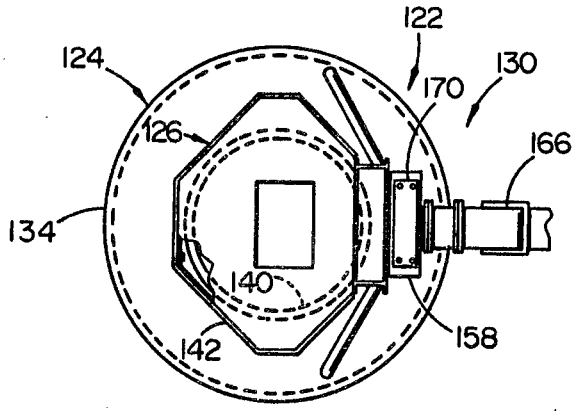
FIG. 5 is a partial cut-away, top plan view of a portion of the exhaust control system shown in FIG. 4, taken along the line 5—5 thereof.
Figure 4:
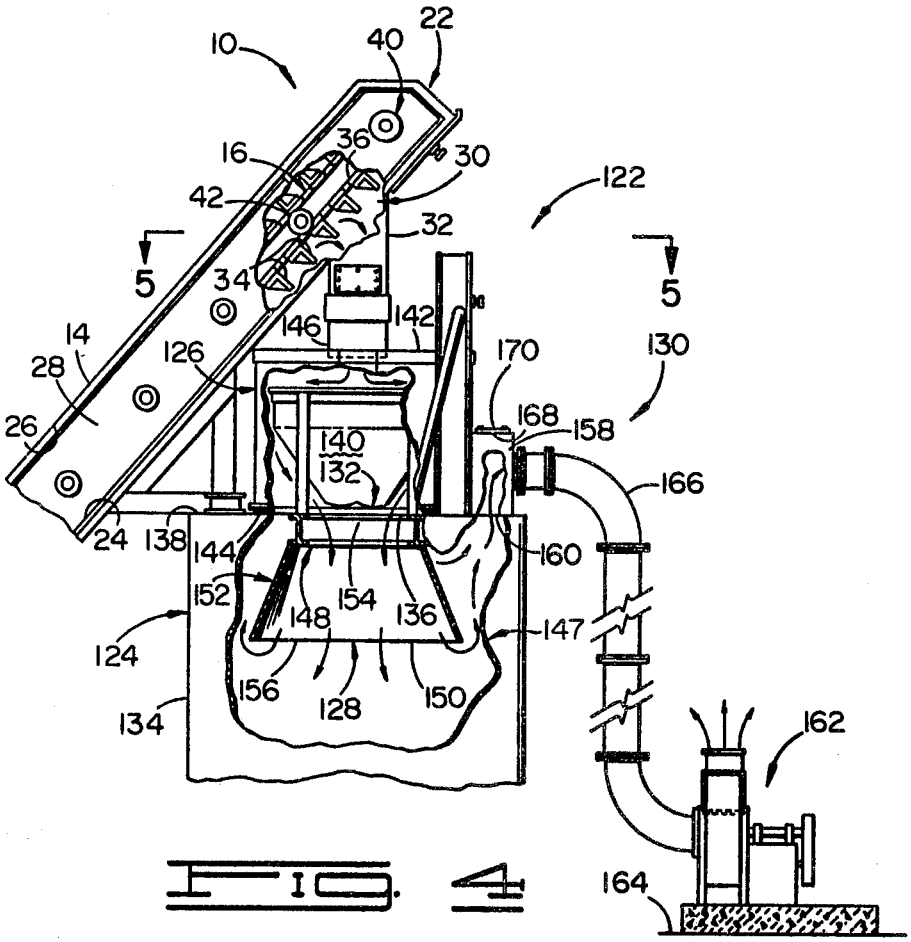
FIG. 4 is a partial cut-away, side elevational view of an improved exhaust control system constructed in accordance with the preferred embodiment of the present invention.

Referring now to FIGS. 4 and 5, shown therein and referred to by the general reference numeral 122 is an improved exhaust control assembly for use with the conveyor apparatus 10. In particular, the exhaust control system 122 is designed to efficiently and economically minimize the quantity of solid particle pollutants expelled into the surrounding atmosphere as a result of operating the conveyor apparatus 10. The exhaust control assembly 122 is comprised primarily of a particulate material storage assembly 124, a conduit assembly 126 connecting the storage assembly 124 to the conveyor assembly 10, an exhaust velocity control assembly 128 disposed generally inside the storage assembly 124, and an exhaust assembly 130.

The storage assembly 124 is disposed vertically below the output end 22 of the conveyor apparatus 10 with an input portion 132 thereof positioned to receive the particulate material discharged from the output chute 32 of the conveyor apparatus 10. More particularly, the storage assembly 24 includes a surge bin 134 having an input port 136 provided through an upper end 138 thereof. In the preferred embodiment, the storage assembly 124 also includes a slug feeder 140 interposed generally between the output end 22 of the conveyor apparatus 10 and the input portion 132 of the storage assembly 124, the slug feeder 140 being constructed in a conventional manner to intermittently feed "slugs" of the particulate material being continuously discharged from the conveyor apparatus 10 into the surge bin 134.

The conduit assembly 126 is connected between the output end 22 of the conveyor apparatus 10 and the input portion 132 of the storage assembly 124 and conducts the particulate material and the products of combustion produced by the flame burner 44 which issue as an exhaust stream from the output chute 32 of the conveyor apparatus 10 into the storage assembly 124 via the input portion 132 thereof. In particular, the conduit assembly 126 consists of a slug feeder shroud 142 which is disposed around the slug feeder 140, with a lower end 144 connected to the upper end 138 of the surge bin 134 around the input port 136, and an upper end 146 connected to the output chute 32 of the conveyor apparatus 10. As can be seen best in FIG. 5, the slug feeder shroud 142 is somewhat taller and wider than the slug feeder 140 enclosed therein, thereby defining a flow path around the slug feeder 140 into the surge bin 134 for the gaseous component of the exhaust stream issuing through the output chute 32 of the conveyor apparatus 10.

The exhaust velocity control assembly 128 is connected to the storage assembly 124 around the input portion 132 thereof and extends downwardly within the storage assembly 124 from the input portion 132 to a medial portion 147 thereof. The exhaust velocity control assembly 128 is constructed to rapidly decrease the velocity of the exhaust stream, so that substantially all of the particulate material entrained therein will precipitate under the influence of gravity out of the exhaust stream and be retained in the storage assembly 124. The exhaust velocity control assembly 128 has an inlet portion 148 connected around the input portion 132 of the storage assembly 124, and an outlet portion 150 disposed vertically lower than the inlet portion 148 thereof, with the outlet portion 150 being disposed generally adjacent to, but spaced inwardly from, adjacent portions of the storage assembly 124. Preferably, the cross-sectional area of the outlet portion 150 is substantially greater than the cross-sectional area of the inlet portion 148. In the preferred form shown in FIG. 4, the exhaust velocity control assembly 128 is comprised of a downwardly diverging frusto-conical shroud 152 having an upper end 154 connected to the upper end 138 of the surge bin 134 around the input port 136, and a lower end 156, of substantially larger diameter, disposed adjacent to, but spaced inwardly from, the perimeter of the surge bin 134.

The exhaust assembly 130 is connected to the storage assembly 124 vertically above the medial portion 147, and controls the exit of the exhaust stream from the storage assembly 124. In particular, the exhaust assembly 130 is constructed so that the exhaust stream exiting downwardly from the exhaust velocity control assembly 128 will reverse direction and flow upwardly for exit from the storage assembly 124. More particularly, the exhaust assembly 130 includes a plenum 158 connected to the upper end 138 of the surge bin 134 around an exhaust port 160 provided therethrough, and an exhaust blower assembly 162 which may be disposed on the ground 164 adjacent to the storage assembly 124 and connected to the plenum 158 via an exhaust air conduit 166.

In operation, the particulate material and products of combustion exiting from the conveyor apparatus 10 via the outlet port 30 will be conducted downwardly via the output chute 32 into the slug feeder shroud 142 wherein the exhaust gases and other products of combustion will be directed over, and downwardly past the slug feeder 140 for introduction into the exhaust velocity control assembly 128 substantially independently of the particulate material. During transit of the exhaust velocity control assembly 128, the velocity of the exhaust stream will be substantially decreased, thereby decreasing the ability of the exhaust stream to carry particulate material entrained therein. The resultant tendency of the entrained particulate material to precipitate out of the exhaust stream is further enhanced by the reversal of flow direction which occurs when the exhaust gases exit from the outlet portion 150 and turn upwardly for exit via the exhaust assembly 130. The operation of the exhaust blower assembly 162 may be varied in a conventional manner to control the draft characteristics of the system. However, it has been determined that in many situations, such as in the recycling of asphaltic particulate, the exhaust stream exiting from the storage assembly 124 via the exhaust port 160 is sufficiently free from solid particle pollutants to enable the products of combustion to be directly exhausted into the surrounding environment through an auxiliary port 168 provided in the plenum 158 upon removal of an associated cover plate 170.

Changes may be made in the construction and the arrangement of the parts or the elements of the various embodiments as disclosed herein without departing from the spirit and scope of the invention as defined in the following claims.

What is claimed is:

1. In a conveyor apparatus in which a conveyor is supported by a plurality of pulleys and enclosed by a conveyor housing having an input end and an output end, the conveyor powered to convey particulate material from the input end for discharge from the output end which is disposed vertically higher than the input end, the improvement comprising:

burner means, supported by the conveyor housing between the input end and the output end and including a flame burner, for directly heating the particulate material conveyed by the conveyor via the flame burner in one position thereof, and for indirectly heating the particulate material conveyed by the conveyor via the products of combustion only of the flame burner in one other position thereof.

2. The improvement of claim 1 wherein the conveyor housing is characterized as having a heating port provided through a medial portion thereof, and wherein the burner means further comprises:

a primary combustion chamber having an inlet portion connected to the flame burner and an outlet portion, the flame and products of combustion produced by the flame burner entering the primary combustion chamber via the inlet portion and exiting the primary combustion chamber via the outlet portion;

a secondary combustion chamber having an inlet portion disposed adjacent to the outlet portion of the primary combustion chamber and an outlet portion connected to the conveyor housing around the heating port, the secondary combustion chamber disposed to admit the flame and products of combustion provided by the flame burner via the inlet portion and to introduce the flame and products of combustion into the conveyor housing via the outlet portion in a first position of the primary combustion chamber relative to the secondary combustion chamber, and the secondary combustion chamber disposed to introduce the products of combustion only in a second position of the primary combustion chamber; and positioning means, having a portion connecting the primary combustion chamber to the secondary combustion chamber with the outlet portion of the primary combustion chamber communicating with the inlet portion of the secondary combustion chamber, for selectively positioning the primary combustion chamber in one of the first position thereof relative to the secondary combustion chamber so that the flame as well as the products of combustion produced by the flame burner are introduced into the conveyor apparatus to directly heat the particulate material therein, and the second position thereof relative to the secondary combustion chamber so that the products of combustion only are introduced into the conveyor apparatus to indirectly heat the particulate material therein.

3. The improvement of claim 1 further comprising:

particulate material storage means, disposed vertically below the output end of the conveyor housing and having an input portion, for receiving the particulate material discharged from the conveyor;

conduit means, connected between the output end of the conveyor housing and the input portion of the particulate material storage means, for conducting the particulate material and the products of combustion produced by the flame burner and issuing as an exhaust stream from the output end of the conveyor housing into the input portion of the particulate material storage means;

exhaust velocity control means, disposed within and connected to the particulate material storage means around the input portion thereof and extending downwardly within the particulate material storage means from the input portion thereof to a medial portion thereof, for rapidly decreasing the velocity of the exhaust stream; and exhaust means, connected to the particulate material storage means vertically above the medial portion, for controlling the exit of the exhaust stream from the particulate material storage means so that the exhaust stream exiting downwardly from the exhaust velocity control means will reverse direction and flow upwardly for exit from the particulate material storage means and substantially all particulate material entrained therein will precipitate out of the exhaust stream and be retained in the particulate material storage means.

4. The improvement of claim 3 wherein the exhaust velocity control means is further characterized as having an inlet portion connected around the input portion of the particulate material storage means and an outlet portion disposed vertically lower than the inlet portion thereof and generally adjacent to and spaced inwardly from the medial portion of the particulate material storage means, and cross-sectional area of the outlet portion being substantially greater than the cross-sectional area of the inlet portion.

5. The improvement of claim 3 wherein the exhaust velocity control means is further characterized as a downwardly diverging frusto-conical shroud having an upper end connected around the input portion of the particulate material storage means, and a lower end disposed adjacent to and spaced inwardly from the medial portion of the particulate material storage means.

6. In a conveyor apparatus in which a conveyor is supported by a plurality of pulleys and enclosed by a conveyor housing having an input end and an output end, the conveyor powered to convey particulate material from the input end for discharge from the output end which is disposed vertically higher than the input end, the apparatus including a burner assembly for producing heated products of combustion for discharge with the particulate material from the output end, the improvement comprising:

particulate material storage means for receiving the particulate material discharged from the output end of the conveyor housing, the particulate material storage means characterized as having an input portion disposed vertically below the output end of the conveyor housing and having a slug feeder disposed to feed slugs of particulate material collected from the output end;

conduit means, connected between the output end of the conveyor housing and the input portion of the particulate material storage means, for conducting the particulate material and the products of combustion produced by the burner means and issuing as an exhaust stream from the output end of the conveyor housing into the input portion of the particulate material storage means;

exhaust velocity control means, connected to the particulate material storage means around the input portion thereof and extending downwardly within the particulate material storage means to a medial portion thereof, for rapidly decreasing the velocity of the exhaust stream; and exhaust means, connected to the particulate material storage means vertically above the medial portion, for controlling the exit of the exhaust stream from the particulate material storage means so that the exhaust stream exiting downwardly from the exhaust velocity control means reverses direction and flows upwardly to exit from the particulate material storage means and substantially all particulate material entrained therein will precipitate out of the exhaust stream and be retained in the particulate material storage means.

7. The improvement of claim 6 wherein the exhaust velocity control means is further characterized as having an inlet portion connected around the input portion of the particulate material storage means and an outlet portion disposed vertically lower than the inlet portion thereof and generally adjacent to and spaced inwardly from the medial portion of the particulate material storage means, the cross-sectional area of the outlet portion being substantially greater than the cross-sectional area of the inlet portion.

8. The improvement of claim 6 wherein the exhaust velocity control means is further characterized as a downwardly diverging frusto-conical shroud having an upper end connected around the inlet portion of the particulate material storage means, and a lower end disposed adjacent to and spaced inwardly from the medial portion of the particulate material storage means.

* * * * *